US008226446B2

(12) United States Patent
Kondo et al.

(10) Patent No.: US 8,226,446 B2
(45) Date of Patent: Jul. 24, 2012

(54) TERMINAL CONNECTOR FOR A REGULATOR

(75) Inventors: Tetsuya Kondo, Saitama (JP); Kuniaki Arakawa, Saitama (JP); Hajime Soda, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 51 days.

(21) Appl. No.: 12/880,568

(22) Filed: Sep. 13, 2010

(65) Prior Publication Data

US 2011/0065310 A1 Mar. 17, 2011

(30) Foreign Application Priority Data

Sep. 16, 2009 (JP) ..... 2009-214965

(51) Int. Cl.
*H01R 9/22* (2006.01)

(52) U.S. Cl. ..... 439/719; 439/488

(58) Field of Classification Search ..... 439/488, 439/709–719, 792, 797, 801, 805, 810
See application file for complete search history.

(56) References Cited

U.S. PATENT DOCUMENTS

| | | | | |
|---|---|---|---|---|
| 5,203,724 | A * | 4/1993 | Casey | 439/792 |
| 6,461,171 | B2 * | 10/2002 | Kanaoka et al. | 439/76.2 |
| 6,824,432 | B2 * | 11/2004 | Katsuzawa et al. | 439/709 |
| 6,860,763 | B2 * | 3/2005 | Kanaoka et al. | 439/620.26 |
| 7,285,019 | B2 * | 10/2007 | Sakai et al. | 439/620.09 |
| 7,811,116 | B2 * | 10/2010 | Sakakura et al. | 439/364 |

FOREIGN PATENT DOCUMENTS

| | | | |
|---|---|---|---|
| EP | 0 649 215 | A1 | 4/1995 |
| EP | 0 697 732 | A2 | 2/1996 |
| EP | 1 174 992 | A2 | 1/2002 |
| EP | 2 015 626 | A2 | 1/2009 |
| FR | 2 816 462 | A1 | 5/2002 |
| JP | 2003-346941 | A | 5/2003 |
| JP | 2008-245361 | A | 9/2008 |

OTHER PUBLICATIONS

European Search Report application No. 10171602.5 dated Oct. 10, 2010.

* cited by examiner

*Primary Examiner* — Thanh Tam Le
(74) *Attorney, Agent, or Firm* — Squire Sanders (US) LLP

(57) ABSTRACT

A terminal connector for a regulator and a method for connecting an external terminal to the terminal connector are provided, whereby the regulator is configured to control an output of a generator provided to a motorcycle. The terminal connector is configured to connect the regulator and external terminals using bolts and nuts, and includes a plurality of terminal units. Each terminal unit is individually connected to an external terminal, and is configured in a width direction of the terminal connector. Each terminal unit is configured as a support base for screw-tightening, to which one of the external terminals is connected by screwing, and includes an identification mark. At least two of the terminal units have different widths.

8 Claims, 7 Drawing Sheets

(a)

(b)

TERMINAL CONNECTOR FOR A REGULATOR

BACKGROUND

1. Field

Embodiments of the invention relate to a terminal connector for a regulator.

2. Description of the Related Art

Japanese Patent Application Publication No. 2008-245361 ("JP '361") discloses a conventional terminal connector for a regulator provided in an AC generator.

As illustrated in FIGS. 4(*b*) and 5(*a*) to 5(*e*) of JP '361, a regulator 14 includes a regulator board 14P and multiple lead wires extending from the regulator board 14P. The multiple lead wires are connected to an external connector terminal 200A1. A terminal A, a terminal RC, and a terminal L1, which are male connector terminals provided at an end portion of the external connector terminal 200A1, project to the inside of a connector unit 22, and are to be connected to an external connector unit.

Currently, vehicles such as motorcycles require high-output AC generators and large-current regulators to handle increases electrical in loads. The increases in loads can come from, for example, an introduction of electronic fuel injection, electric devices provided in the intake and exhaust systems, an increase in size and a higher output of headlamps, and additional options, such as grip heaters and fog lamps.

In such cases, a connector unit, i.e., a unit connecting a regulator to an external harness, is required to secure a sufficient current capacity. Conventional connector units can only establish a connection, failing to secure a sufficient current capacity. For this reason, terminals of the regulator are connected to the connector unit with bolts and nuts, for example, where a cathode terminal and an anode terminal of a battery are connected.

When a terminal of the regulator is connected, the connection position should not be mistaken and the connection position should be made easily recognizable.

Even when an external connection terminal is connected to an incorrect connection terminal of the regulator, the external connection terminal can be immediately reconnected to a correct position, if the incorrect connection is easily identified.

Furthermore, when a large current passes through the terminal A, the terminal RC, and the terminal L1, it is desirable that the external connection terminal is securely connected.

SUMMARY

Embodiments of the invention provide a terminal connector for a regulator, which, when a larger-capacity regulator is employed, makes a connection position of an external terminal more recognizable, makes it unlikely that the external terminal is connected to an incorrect position, and allows a more secure connection of the external terminal.

An embodiment of the invention provides a terminal connector for a regulator, whereby the regulator is configured to control an output of a generator provided to a motorcycle. The terminal connector is configured to connect the regulator and external terminals using bolts and nuts, and includes a plurality of terminal units. Each terminal unit is individually connected to an external terminal, and is configured in a width direction of the terminal connector. Each terminal unit is configured as a support base for screw-tightening, to which one of the external terminals is connected by screwing, and includes an identification mark. At least two of the terminal units have different widths.

Another embodiment of the invention provides a method for connecting a terminal connector of a regulator, which includes connecting an external terminal to a terminal unit of the terminal connector. The terminal unit includes a positioning identification mark. The terminal unit is configured in a width direction of the terminal connector and configured as a support base for securing the external terminal.

In accordance with another embodiment of the invention, the plurality of terminal units includes a cathode-side connecting unit to which the external terminal at a cathode-terminal side of a battery is connected, a ground-side connecting unit which is connected to a ground, and to which the external terminal at an anode-terminal side of the battery is connected, and three generator-side connecting units to which the external terminals at a side of the generator are connected.

In accordance with another embodiment of the invention, the cathode-side connecting unit and the ground-side connecting unit are respectively arranged at both ends of the terminal connector in an arrangement direction, and the generator-side connecting units are arranged between the cathode-side connecting unit and the ground-side connecting unit.

In accordance with another embodiment of the invention, the identification mark includes a + symbol engraved in the cathode-side connecting unit, a − symbol engraved in the ground-side connecting unit, and a ~ symbol engraved in each of the generator-side connecting units.

In accordance with another embodiment of the invention, a width of the cathode-side connecting unit is formed wider than widths of the ground-side connecting unit and the generator-side connecting units, and the width of the ground-side connecting unit is formed equal to the widths of the generator-side connecting units.

In accordance with another embodiment of the invention, female screws for screw-tightening the external terminals to the terminal units are formed in the terminal units. A center of the female screw for the cathode-side connecting unit is arranged at a position offset from a center of the width of the cathode-side connecting unit in a width direction, and centers of the female screws for the ground-side connecting unit and the generator-side connecting units are arranged at centers of the widths of the ground-side connecting unit and the generator-side connecting units.

Embodiments of the invention provide non-obvious advantages over conventional terminal connectors for regulators. For example, according to an embodiment of the invention, the terminal connector includes multiple terminal units to which external terminals are individually connected. These terminal units are arranged in a width direction. The terminal units are each formed as a support base for screw-tightening, to which one of the external terminals is connected. An identification is marked on each of the terminal units. At least two of the terminal units are different from each other in width. Accordingly, by marking the identification on each of the terminal units, the connection positions of the external terminals are made easily recognizable.

In accordance with another embodiment of the invention, by making the widths of the terminal units different from each other, the external terminals to be connected to the terminal units can be formed with different widths corresponding to the respective terminal units to be connected. Hence, although an external terminal having a wide width might be otherwise connected to a terminal unit having a narrow width, it is possible to prevent such incorrect assembling of the external terminal and the terminal unit having the different widths.

Furthermore, in combination with the identification mark, an operation of incorrectly connecting the external terminal to the terminal unit can be avoided. For example, although the external terminal having a narrow width can be connected to the terminal unit having a wide groove width, this operation is made more easily avoidable. This leads to easier avoidance of incorrect assembling and reduction in the number of assembling steps.

Additionally, the external terminals are connected more securely by using the terminal units as the support bases for screw-tightening.

In accordance with another embodiment of the invention, the terminal units are cathode-side connecting unit to which the external terminal at the cathode-terminal side of the battery is connected, a ground-side connecting unit which is connected to the ground, and to which the external terminal at the anode-terminal side of the battery is connected; and three generator-side connecting units to which the external terminals at the side of the generator are connected. This makes it possible to rectify, by the regulator, an alternating current generated by the generator and to supply the rectified current to the battery while adjusting the voltage.

In accordance with another embodiment of the invention, the cathode-side connecting unit and the ground-side connecting unit are respectively arranged at both ends of the terminal connector in the arrangement direction, and the generator-side connecting units are arranged between the cathode-side connecting unit and the ground-side connecting unit. This may allow the cathode-side connecting unit and the generator-side connecting units, which are the power supply system, to be arranged apart from the ground-side connecting unit, which is the ground system.

In accordance with another embodiment of the invention, the identification mark includes a "+" symbol engraved in the cathode-side connecting unit, a "–" symbol engraved in the ground-side connecting unit, and a "~" symbol engraved in each of the generator-side connecting units. Accordingly, the identification mark is less likely to disappear, and the identification of the terminal units is favorably made over an extended period of time.

In accordance with an embodiment of the invention, the width of the cathode-side connecting unit is formed wider than the widths of the ground-side connecting unit and the generator-side connecting units. The width of the ground-side connecting unit is formed identical to the widths of the generator-side connecting units. Accordingly, the width of the external terminal, which could be connected to the cathode-side connecting unit, can be made wider than the widths of the ground-side connecting unit and the generator-side connecting units. The external terminal, which could be connected to the cathode-side connecting unit, can be prevented from being connected to the ground-side connecting unit and the generator-side connecting units.

In accordance with another embodiment of the invention, the female screws for securing the external terminals to the terminal units are formed in the terminal units. The center of the female screw for the cathode-side connecting unit is provided at the position offset with respect to the center of the width of the cathode-side connecting unit in the width direction. The centers of the female screws for the ground-side connecting unit and the generator-side connecting units are provided at the centers of the widths of the ground-side connecting unit and the generator-side connecting units. Accordingly, when the external terminal, which could be connected to the ground-side connecting unit and the generator-side connecting units, is secured or screw-tightened to the cathode-side connecting unit, the external terminal, which could be connected to the ground-side connecting unit and the generator-side connecting units, comes closer to one end of the width of the cathode-side connecting unit. Hence, such incorrect assembling thereof is easily checked Thus, the external terminal can be correctly and immediately reconnected to a correct terminal unit.

BRIEF DESCRIPTION OF DRAWINGS

FIG. 4(*b*) is a cross-sectional view taken along the b-b line in FIG. 4(*a*), in accordance with an embodiment of the invention.

DETAILED DESCRIPTION OF EMBODIMENTS

Figure 1:
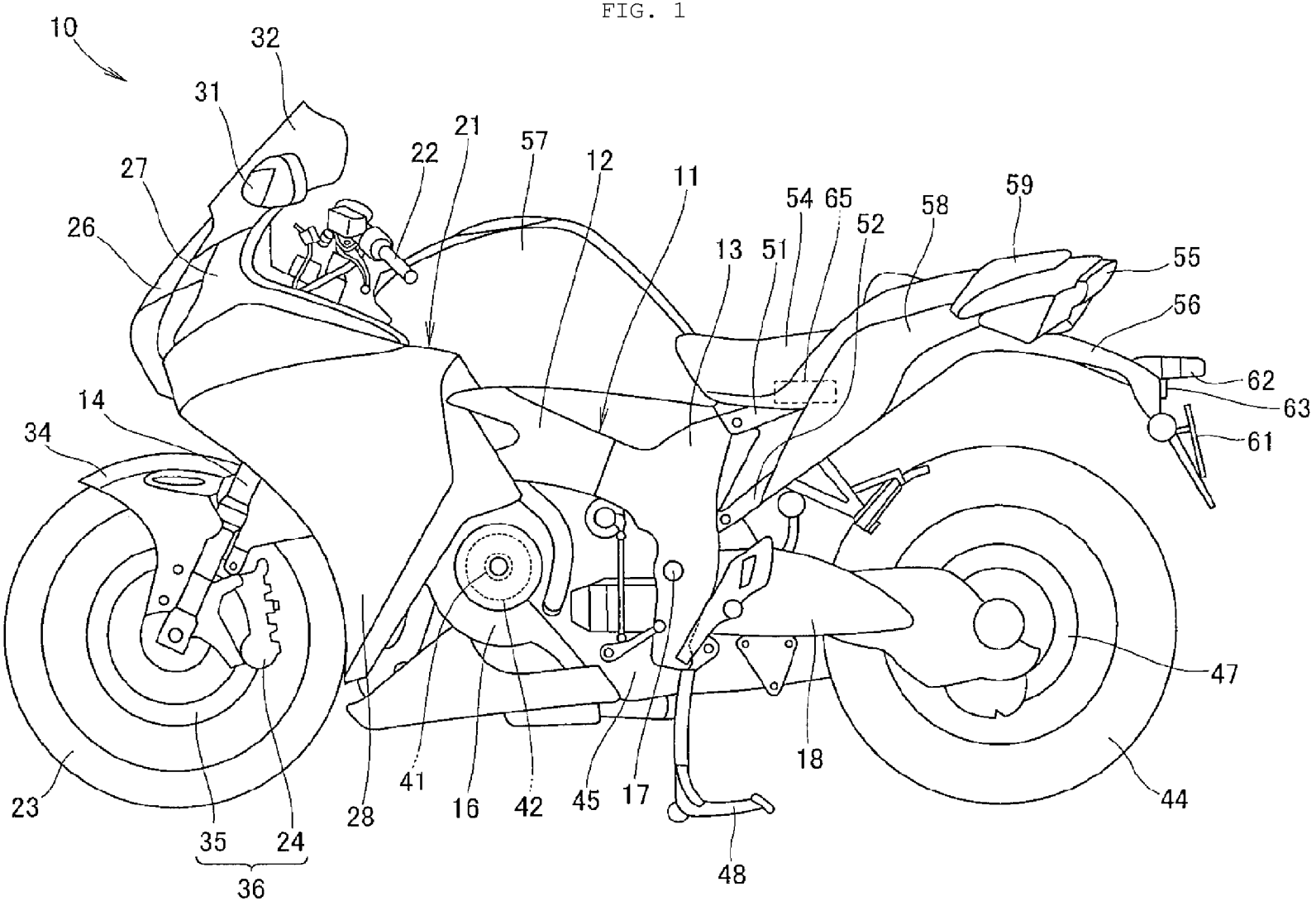
FIG. 1 is a side view of a motorcycle including a terminal connector for a regulator, in accordance with an embodiment of the invention.

Embodiments of the invention will be described below in detail with reference to the accompanying drawings. Left, right, front, and rear in the description indicate directions based on the driver who rides on the vehicle. The accompanying drawings are intended to be seen in the direction of the reference numerals. The arrow with the word FRONT in the accompanying drawings represents the front of the vehicle.

FIG. 1 is a side view of a vehicle, such as a motorcycle, including a terminal connector for a regulator, in accordance with an embodiment of the invention. A motorcycle 10 is shown in FIG. 1. The motorcycle 10 include a body frame 11 that serves as a framework of the motorcycle 10. The body frame 11 includes a pair of right and left main frames 12, 12 (only reference numeral 12 on the near side is illustrated), and a pair of right and left pivot plates 13, 13 (only reference numeral 13 on the near side is illustrated) connected to rear end portions of the main frames 12, 12, respectively. A steerable front fork 14 is supported to front end portions of the main frames 12, 12. A transmission-integrated engine 16 is supported by the main frames 12, 12 and the pivot plates 13, 13. A swingarm 18 is supported by the pivot plates 13, 13 in a vertically swingable manner around a pivot shaft 17.

The front and both sides of an upper portion of the front fork 14 are covered with a cowling 21. A bar handle 22 is attached to an upper end portion of the front fork 14. A front wheel 23 and a brake caliper 24 are attached to a lower end portion of the front fork 14.

The cowling 21 includes a front cowl 27 to which a headlamp 26 is attached, and a pair of right and left side cowls 28, 28 (only reference numeral 28 on the near side is illustrated). Each right and left side cowl 28, 28 can spread rearward and downward from the side of the front cowl 27. Reference numerals 31, 31 (only reference numeral 31 on the near side is illustrated) denote a pair of right and left front winkers which are attached to the front cowl 27. Reference numeral 32 denotes a windscreen which extends obliquely upward and rearward from an upper portion of the front cowl 27.

An upper portion of the front wheel 23 is covered with a front fender 34 attached to the front fork 14.

The brake caliper 24 and a brake disc 35 integrally attached to the front wheel 23 to constitute a front disc brake 36.

The engine 16 includes, in its crankcase, a crankshaft 41 extending in a vehicle-width direction and an AC generator 42 having a rotor and a stator respectively attached to two opposite ends of the crankshaft 41.

A front end portion of the swingarm 18 is attached to the pivot shaft 17, and a rear end portion of the swingarm 18 is attached to a rear wheel 44. A drive shaft (not shown), which transmits power to the rear wheel 44 from a transmission 45 provided at a rear portion of the engine 16, is accommodated inside the swingarm 18. Reference numeral 47 denotes a brake disc which constitutes constitute a rear disc brake. Reference numeral 48 denotes a main stand which is attached to the right and left pivot plates 13, 13.

A pair of right and left seat rails 51, 51 (only reference numeral 51 on the near side is illustrated) and a pair of right and left subframes 52, 52 (only reference numeral 52 on the near side is illustrated) are attached to rear upper portions of the pivot plates 13, 13. Rear end portions of the seat rails 51, 51 are connected to rear end portions of the subframes 52, 52.

A seat 54 and a rear combination lamp 55 disposed behind the seat 54 are attached to the seat rails 51, 51. A rear fender 56, which covers an upper portion of the rear wheel 44, is attached to the seat rails 51, 51 and the subframes 52, 52.

Reference numeral 57 denotes a fuel tank that can be attached to an upper portion of the body frame 11. Reference numerals 58, 58 (only reference numeral 58 on the near side is illustrated) denote a pair of right and left side covers which cover lower side portions of the seat 54. Reference numerals 59, 59 (only reference numeral 59 on the near side is illustrated) denote a pair of right and left grab rails which the passenger seated on a rear portion of the seat 54 can hold. Reference numeral 61 denotes a license plate. Reference numeral 62 denotes a license-plate lamp. Reference numeral 63 denotes a reflex reflector.

A regulator 65 for controlling output of the AC generator 42 is disposed between the right and left seat rails 51, 51 and below the seat 54. The regulator 65 is connected to a battery (non-illustrated).

Figure 2:
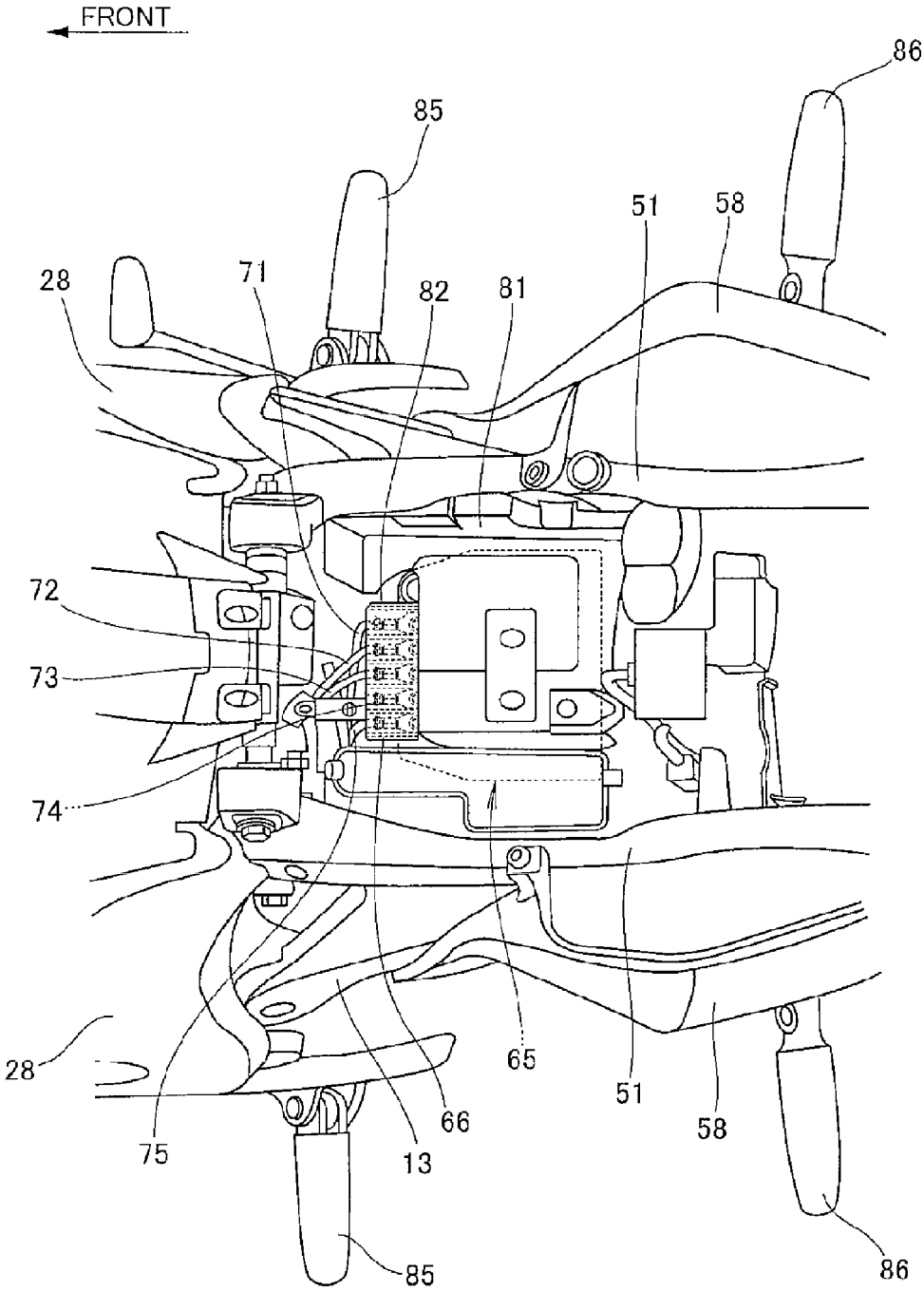
FIG. 2 is a plan view of a principal part of the motorcycle, showing an arrangement of the regulator, in accordance with an embodiment of the invention.

FIG. 2 is a plan view of a principal part of the motorcycle, showing an arrangement of the regulator, in accordance with an embodiment of the invention. As shown in FIG. 2, the regulator 65 is disposed between the right and left seat rails 51, 51. Multiple external cables 71 to 75 are connected to a terminal connector 66 provided at a front portion of the regulator 65. Reference numeral 81 denotes a regulator cover which covers the most of an area of an upper portion of the regulator 65. Reference numeral 82 denotes a connector cover which covers an upper portion of the terminal connector 66 of the regulator 65. Reference numerals 85, 85 denote the driver's steps. Reference numerals 86, 86 denote the passenger's steps.

Figure 3:
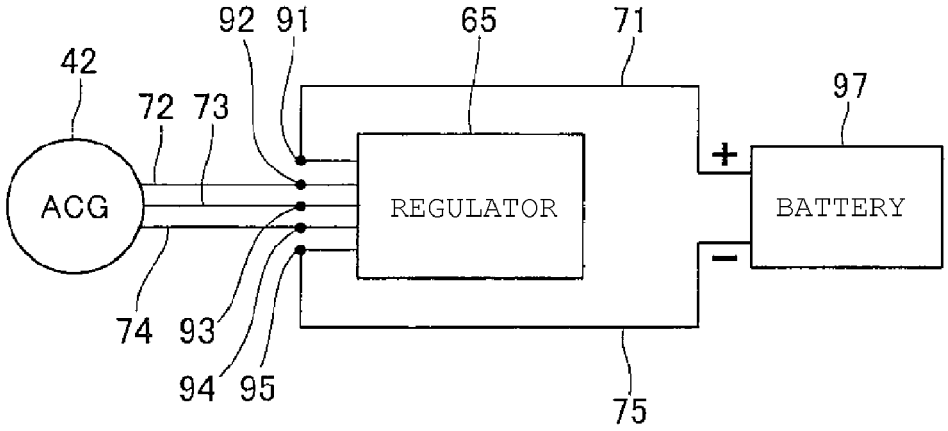
FIG. 3 is a circuit diagram showing a connection state of the regulator, in accordance with an embodiment of the invention.

FIG. 3 is a circuit diagram showing a connection state of the regulator, in accordance with an embodiment of the invention. As shown in FIG. 3, the regulator 65 includes a rectifier built therein. The rectifier is configured to rectify a three-phase alternating current outputted from the AC generator 42 and to convert the alternating current to a direct current. The regulator 65 includes connection terminals 91 to 95 to which the external cables 71 to 75 are connected, respectively.

The external cable 71 is connected to the connection terminal 91. The external cable 71 is a cable at a cathode side of a battery 97, and extends from a cathode terminal of the battery 97. The external cables 72 to 74 are connected to the connection terminals 92 to 94, respectively. The external cables 72 to 74 are three-phase output cables, and extend from the AC generator 42 of three-phase output type. The external cable 75 is connected to the connection terminal 95. The external cable 75 is connected to the ground and also to an anode terminal of the battery 97.

Figure 4:
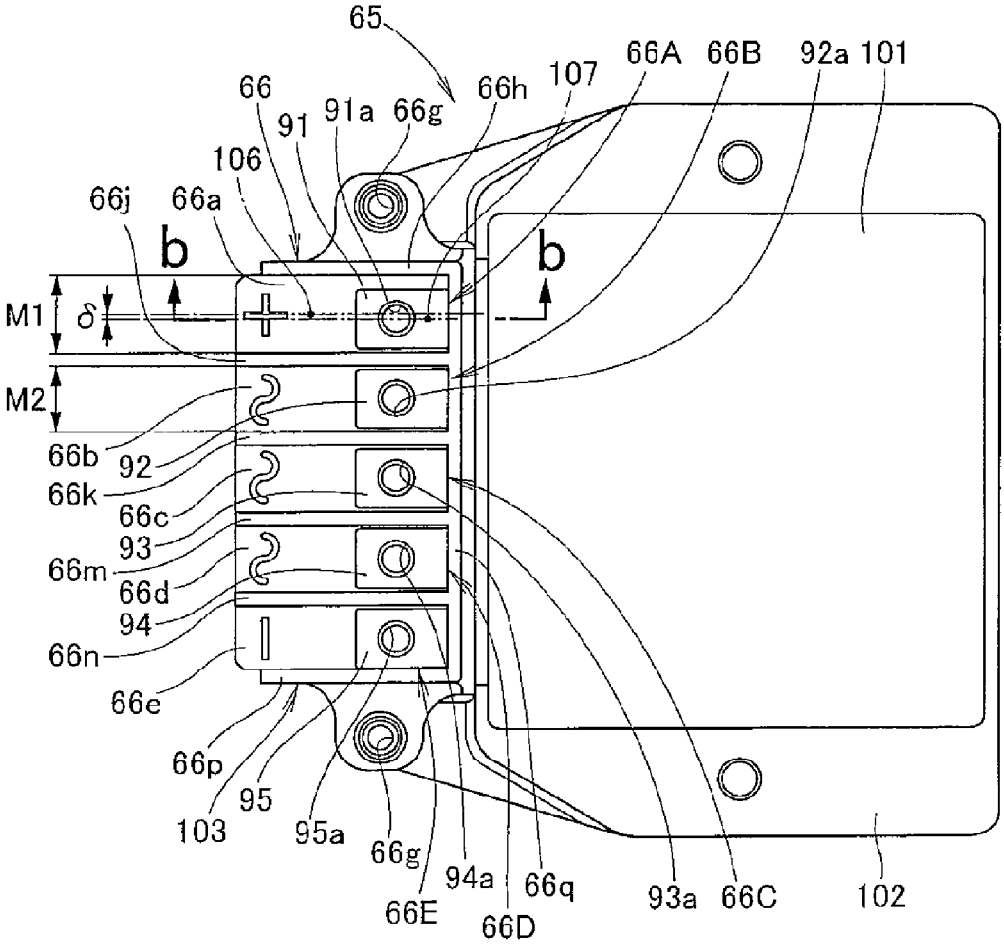
FIG. 4(*a*) is an explanatory view showing the regulator, in accordance with an embodiment of the invention.
Figure 4:
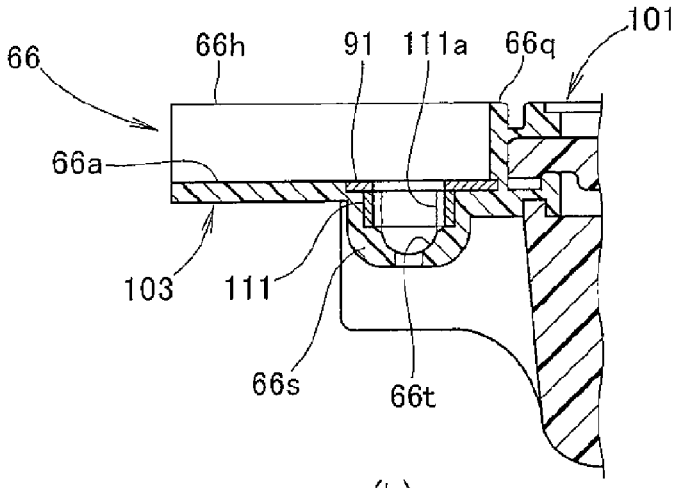

FIG. 4(*a*) is an explanatory view showing the regulator, in accordance with an embodiment of the invention. As shown in FIG. 4(*a*), the regulator 65 includes a rectangular regulator body part 101, the terminal connector 66 provided at one end of the regulator body part 101, and a flange part 102 provided around the regulator body part 101 and the terminal connector 66.

The terminal connector 66 includes the connection terminal 91 to 95 and a terminal attachment part 103 made of a resin insulator, to which these connection terminals 91 to 95 are attached.

Multiple terminal grooves 66*a* to 66*e* are formed in the terminal attachment part 103. The connection terminals 91 to 95 are attached to the terminal grooves 66*a* to 66*e*, respectively. Reference numerals 66*g*, 66*g* denote cover attachment holes for attaching the connector cover 82 (see FIG. 2) which covers end portions of the external cables 71 to 75 (see FIG. 2) connected to the connection terminals 91 to 95.

Each of the terminal grooves 66*a* to 66*e* has an end portion with a bottom surface engraved for identification. For example, the terminal groove 66*a* has a "+" symbol, the terminal grooves 66*b* to 66*d* each have a "~" symbol, and the terminal groove 66*e* has a "−" symbol.

Side walls 66*h*, 66*j*, 66*k*, 66*m*, 66*n*, 66*p* of the terminal grooves 66*a* to 66*e* and a back wall 66*q* connecting end portions of these side walls 66*h*, 66*j*, 66*k*, 66*m*, 66*n*, 66*p* can be formed taller than top surfaces of the connection terminals 91 to 95, and also can be formed taller than external terminals of the external cables 71 to 75 connected to the connection terminals 91 to 95.

The connection terminals 91 to 95 are can be rectangular components attached to the bottom surface at end portions, on a side of the regulator body part 101, of the terminal grooves 66*a* to 66*e*. The connection terminals 91 to 95 can respectively include bolt insertion holes 91*a* to 95*a* opened therein. Bolts for attaching the external cables 71 to 75 are passed through the bolt insertion holes 91*a* to 95*a*.

The terminal groove 66*a* has a groove width M1. The terminal grooves 66*b* to 66*e* each have a groove width M2 that is narrower than the groove width M1 (M1>M2). Reference numeral 106 in the drawing denotes a center line of the groove width (hereinafter, groove-width center line) of the terminal groove 66*a*. Reference numeral 107 denotes a center line of the bolt insertion hole (hereinafter, bolt-insertion-hole center line) passing through the bolt insertion hole 91*a* and extending in parallel to the groove-width center line 106 of the terminal groove 66*a*. The bolt-insertion-hole center line 107 is offset with respect to the groove-width center line 106 in a groove-width direction toward the terminal groove 66*b* only by an offset amount δ.

The bolt insertion hole 92*a* (as well as the bolt insertion holes 93*a* to 95*a*) is opened at the center of the groove width of the terminal groove 66*b* (as well as the terminal grooves 66*c* to 66*e*).

The terminal groove 66*a* and the connection terminal constitute a cathode-side connecting unit 66A. The terminal groove 66*b* and the connection terminal 92 constitute a generator-side connecting unit 66B. The terminal groove 66*c* and the connection terminal 93 constitute a generator-side connecting unit 66C. The terminal groove 66*d* and the connection terminal 94 constitute a generator-side connecting unit 66D. The terminal groove 66*e* and the connection terminal 95 constitute a ground-side connecting unit 66E.

FIG. 4(*b*) is a cross-sectional view taken along the b-b line in FIG. 4(*a*), in accordance with an embodiment of the invention. The connection terminal 91 includes a nut 111 integrally attached to a lower surface thereof. A bolt 126 (see FIG. 7(*a*)) for tightening the external terminal of the external cable 71 (see FIG. 2) is screwed into the nut 111. Reference numeral 111*a* denotes a female screw formed inside the nut 111, which can screw the bolt 126 therein. The center of the female screw 111*a* is located on the bolt-insertion-hole center line 107 (see FIG. 4(*a*)) of the connection terminal 91.

Each of the other connection terminals 92 to 95 (see FIG. 4(*a*)) can also include a nut 111 integrally attached to lower surface thereof.

Reference numeral 66*s* in the drawing denotes a downward protruding part which is formed at a lower portion of the terminal attachment part 103. The downward protruding part 66*s* is formed below each of the connection terminals 91 to 95. Reference numeral 66*t* denotes a lower hole formed in each downward protruding part 66*s* to avoid butting with a tip end of the bolt which is screwed into the nut 111.

The terminal attachment part 103 is attached to an upper side portion of the regulator body part 101. The connection terminals 91 to 95 of the terminal connector 66 are connected to the regulator unit and the rectifier unit in the regulator body part 101 with wires (not shown).

Figure 5:
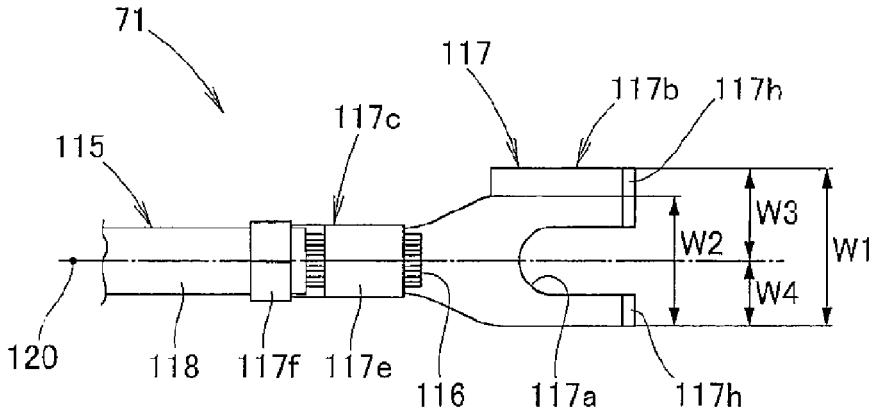
FIG. 5 is a plan view showing a first external cable to be connected to the regulator, in accordance with an embodiment of the invention.

The external cable 71 is a component attached to the connection terminal 91 (see FIG. 4(*a*)) of the regulator (see FIG. 4(*a*)), and includes a wire 115 and a first external terminal 117 connected to a core wire 116 of the wire 115 by compression, as shown in FIG. 5.

The wire 115 includes the core wire 116 and a covering 118 which covers the core wire 116.

The first external terminal 117 includes a connection part 117*b* having a notch 117*a* formed for connection to the connection terminal 91, and a compression part 117*c* provided at an end portion of the connection part 117*b*. Reference numerals 117*h*, 117*h* denote erection parts formed by bending tip end portions of the connection part 117*b*. When erected on the near side of the sheet, the erection parts 117*h*, 117*h* butt a head portion of the bolt that is passed through the notch 117*a*, and prevent pulling off with the bolt.

The connection part 117*b* has a width W1, a width W3 from one edge in a width direction to a center line 120 passing through the centers of the notch 117*a* and the compression part 117*c*, and a width W4 from the other edge to the center line 120. The W4 is narrower than the W3 (W3>W4).

The compression part 117*c* includes a core-wire compression part 117*e* compressed to the core wire 116 and a covering clamping part 117*f* clamped by the covering 118.

Figure 6:
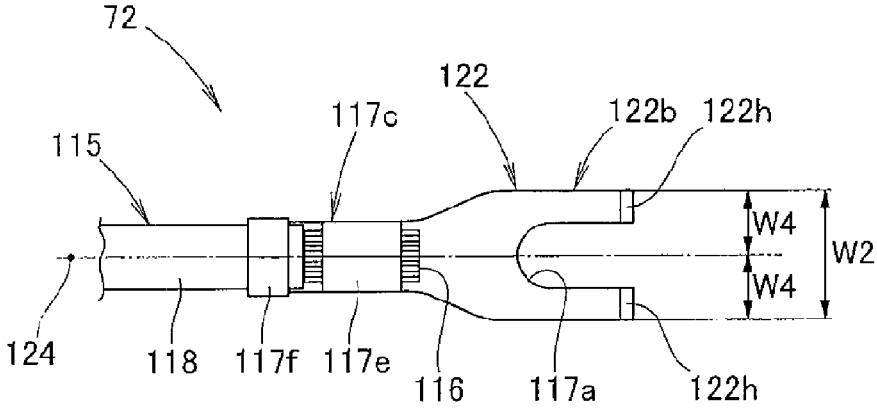
FIG. 6 is a plan view showing a second external cable to be connected to the regulator, in accordance with an embodiment of the invention.

The external cable 72 is a component attached to the connection terminal 92 (see FIG. 4(*a*)) of the regulator (see FIG. 4(*a*)), and includes a wire 115 and a second external terminal 122 connected to a core wire 116 of the wire 115 by compression, as shown in FIG. 6. The external cables 73 to 75 (see FIG. 2) also have identical structures to that of the external cable 72.

The second external terminal 122 includes a connection part 122*b* having a notch 117*a* formed for connection to the connection terminal 92, and a compression part 117*c* provided at an end portion of the connection part 122*b*. Reference numerals 122*h*, 122*h* denote erection parts formed by bending tip end portions of the connection part 122*b*. The function of the erection parts 122*h*, 122*h* is the same as that of the erection part 117*h* discussed above (see FIG. 5).

The connection part 122*b* has a width W2, a width W4 from one edge in a width direction to a center line 124 passing through the centers of the notch 117*a* and the compression part 117*c*, and a width W4 from the other edge to the center line 124. In other words, the connection part 122*b* has a symmetrical shape with respect to the center line 124.

Next, an embodiment of the invention will be described for connecting the first external terminal 117 to the connection terminal 91 discussed above.

Figure 7:
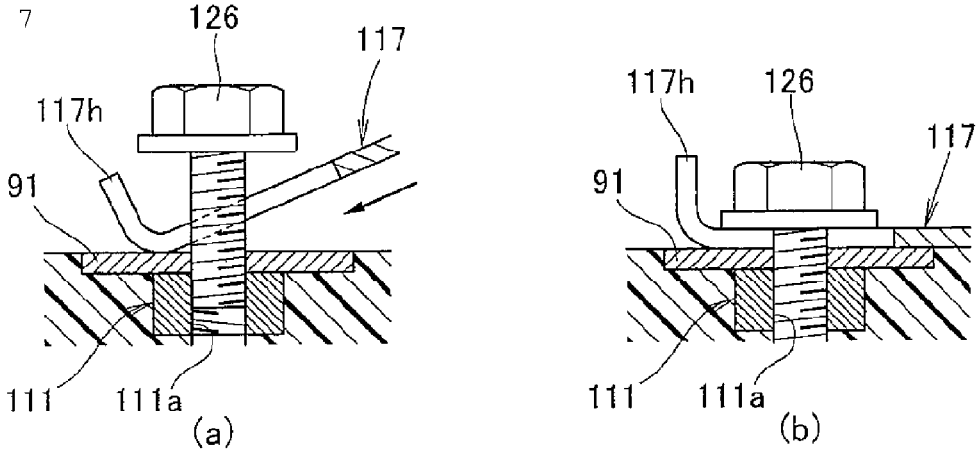
FIGS. 7(*a*) and 7(*b*) are operation views showing the attachment of an external terminal of a first external cable, in accordance with an embodiment of the invention.

FIGS. 7(*a*) to 7(*b*) are operation views showing the attachment of an external terminal of a first external cable, in accordance with an embodiment of the invention. As shown in FIG. 7(*a*), the bolt 126 is screwed and provisionally fitted into the female screw 111*a*. In this state, the first external terminal 117 is inserted between the head portion of the bolt 126 and the connection terminal 91.

Then, as shown in FIG. 7(*b*), the bolt 126 is tightened to connect the first external terminal 117 to the connection terminal 91.

In the state of FIG. 7(*a*) discussed above, even when the first external terminal 117 is provisionally fitted, the forked shape of the first external connection terminal 117, i.e., the pair of erection parts 117*h*, can prevent the first external terminal 117 from being pulled off of the bolt 126 until the bolt 126 shown in FIG. 7(*b*) is tightened.

Connecting the second external terminals 122 (see FIG. 6) to the connection terminals 92 to 95 (see FIG. 4) can be performed in the same manner as described above.

Embodiments of the invention for the operation of the above-described terminal connector for the regulator 65 (embodiment) and operations of a first comparative embodiment to a third comparative embodiment with reference to FIGS. 8(*a*), 8(*b*), 9(*a*), and 9(*b*), will be described below in detail.

Figure 8B:
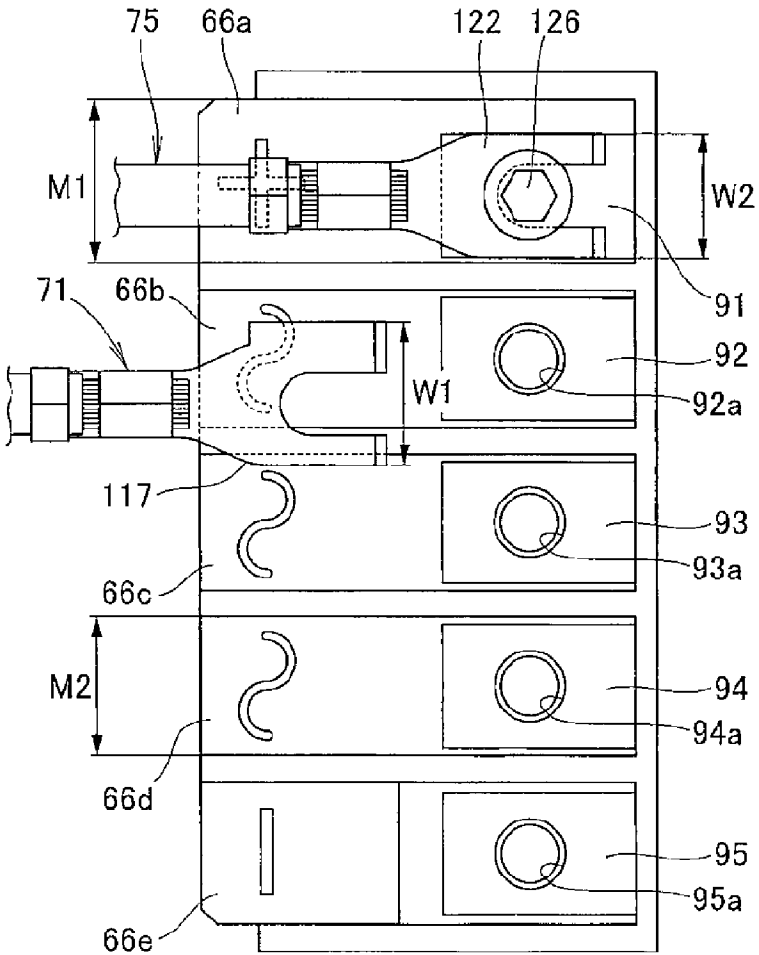
FIGS. 8(*a*) and 8(*b*) show a first operation view illustrating the operation of connecting external cables to connection terminals of regulators, in accordance with an embodiment of the invention.
Figure 8A:
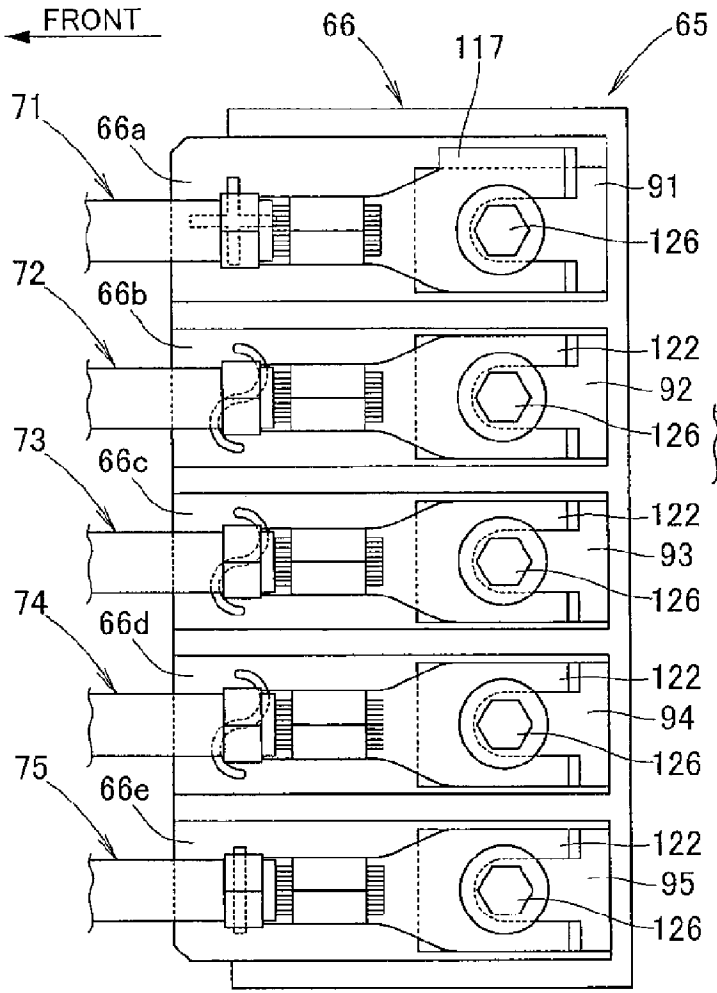

FIGS. 8(*a*) and 8(*b*) show a first operation view illustrating the operation of connecting external cables to connection terminals of regulators, in accordance with embodiments of the invention. FIG. 8(*a*) shows a correct method for connecting the external cables 71 to 75 to the regulator 65, in accordance with an embodiment of the invention.

Specifically, the first external terminal 117 of the external cable 71 is attached to the connection terminal 91 with the bolt 126. The second external terminal 122 of the external cable 72 is attached to the connection terminal 92 with a bolt 126. The second external terminal 122 of the external cable 73 is attached to the connection terminal 93 with a bolt 126. The second external terminal 122 of the external cable 74 is attached to the connection terminal 94 with a bolt 126. The second external terminal 122 of the external cable 75 is attached to the connection terminal 95 with a bolt 126.

In the terminal connector 66 of the regulator 65, the terminal grooves 66*a* to 66*e* have the "+" symbol, the "~" symbols, and the "−" symbol engraved. Accordingly, when the external cables 71 to 75 are attached, these external cables 71 to 75 are less likely to be attached at incorrect positions, and the attachment can be quickly accomplished.

FIG. 8(*b*) shows a first comparative embodiment of the invention. Specifically, FIG. 8(*b*) shows the operation at the time when the external cable 71 is incorrectly attached to any of the connection terminals 92 to 95, or when the external cables 72 to 75 are incorrectly attached to the connection terminal 91, for example.

When the first external terminal 117 of the external cable 71 is to be attached to an incorrect position, i.e., any one of the connection terminals 92 to 95, the operator can avoid incorrectly attaching the first external terminal 117 to the connection terminals 92 to 95, because the width W1 of the first external terminal 117 is wider than the groove width M2 of the terminal grooves 66*b* to 66*e*.

Meanwhile, when the second external terminal 122 of the external cable 75 is to be attached to an incorrect position, for example, the connection terminal 91, the second external terminal 122 may be incorrectly attached to the connection terminal 91 in some cases. This is because the width W2 of the second external terminal 122 is narrower than the groove width M1 of the terminal groove 66*a*.

Regarding this point, the operation in the terminal connector 66 will be further described with reference to FIGS. 9(*a*) and 9(*b*).

Figure 9B:
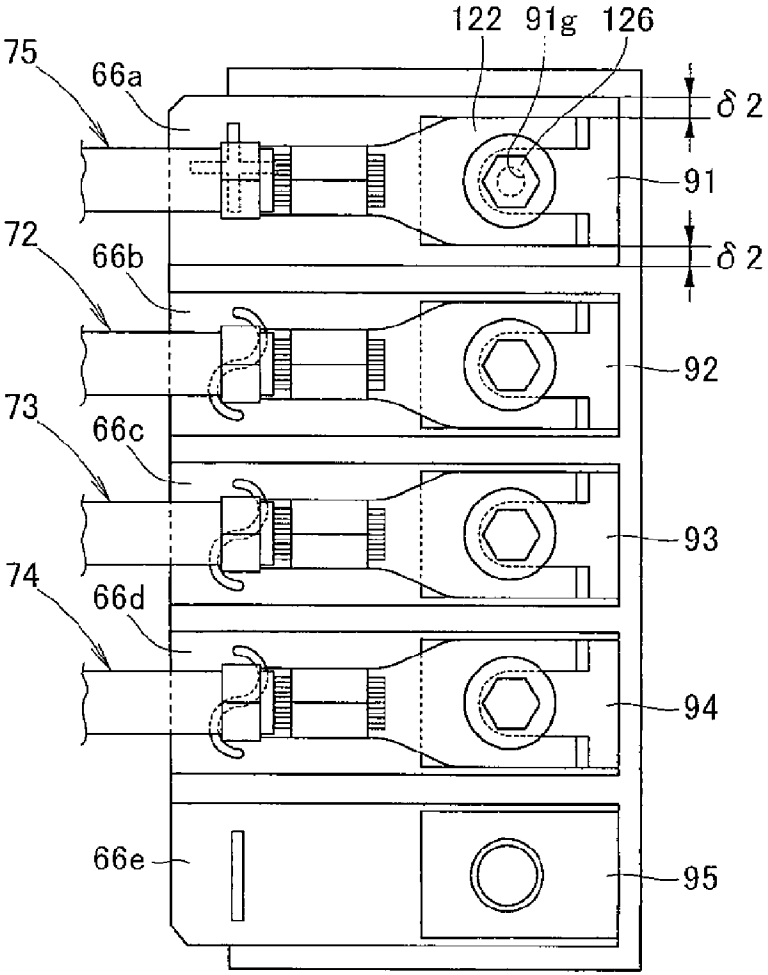
FIGS. 9(*a*) and 9(*b*) show a second operation view illustrating the operation of connecting external cables to connection terminals of regulators, in accordance with an embodiment of the invention.
Figure 9A:
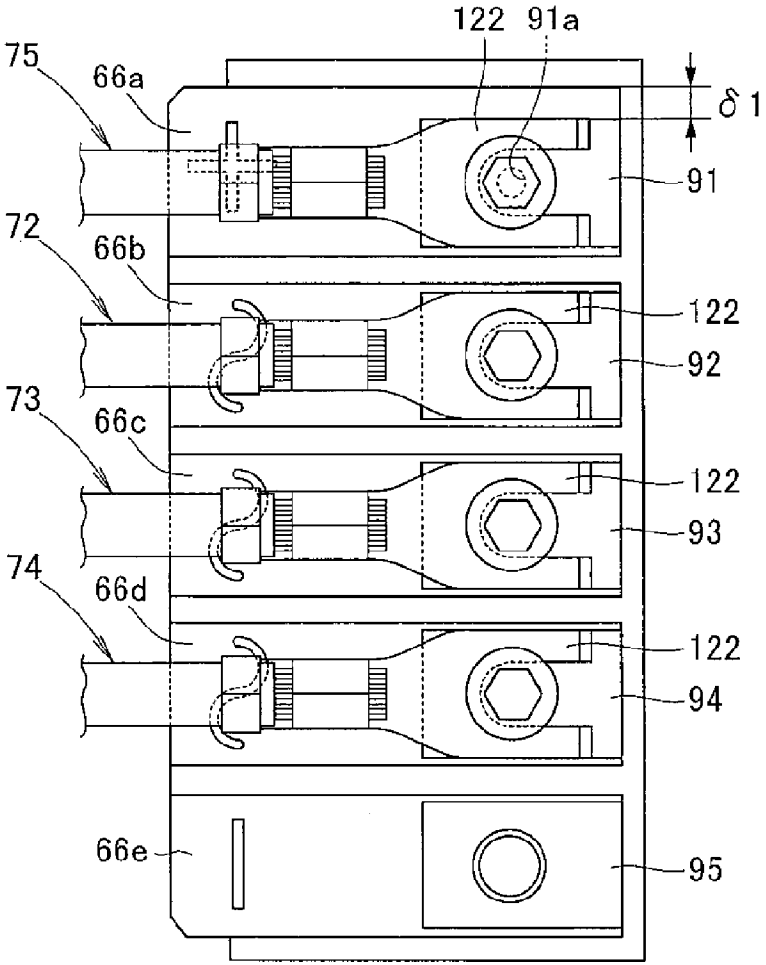

FIGS. 9(*a*) and 9(*b*) show a second operation view illustrating the operation of connecting external cables to connection terminals of regulators, in accordance with embodiment of the invention. FIG. 9(*a*) shows a second comparative embodiment. Specifically, FIG. 9(*a*) shows the external cable 75 attached to the connection terminal 91, as shown in FIG. 8(*b*). The second external terminal 122 of the external cable 72 is attached to the connection terminal 92. The second external terminal 122 of the external cable 73 is attached to the connection terminal 93. The second external terminal 122 of the external cable 74 is attached to the connection terminal 94.

In this case, the distance from one end portion in a groove-width direction of the terminal groove 66*a* to the second external terminal 122 is δ1.

FIG. 9(*b*) shows a third comparative embodiment. Specifically, FIG. 9(*b*) shows that a bolt insertion hole 91*g* provided in the connection terminal 91 and the female screw (not shown) are opened and provided at the center of the groove width of the terminal groove 66*a*. Moreover, the second external terminal 122 of the external cable 75 is attached to the connection terminal 91 with the bolt 126.

In this case, the distance from one end portion in the groove-width direction of the terminal groove 66*a* to the second external terminal 122 is δ2, whereby δ2 shorter than the distance δ1 (δ2<δ1). The distance from the other end portion in the groove-width direction of the terminal groove 66*a* to the second external terminal 122 is also δ2.

The bolt insertion hole 91*a* of the connection terminal 91 can be offset with respect to the center of the groove width of the terminal groove 66*a*, as shown in FIG. 9(*a*). In FIGS. 9(*a*) and 9(*b*) discussed above, the distance δ1 from the one end portion of the terminal groove 66*a* to the second external terminal 122 is made longer than the distance δ2 for the bolt insertion hole 91*g* of the connection terminal 91 which is provided at the center of the groove width of the terminal groove 66*a* as shown in FIG. 9(*b*). Accordingly, this can make the operator more aware that the external cable 75 is attached to an incorrect position.

As shown in FIGS. 1, 2, 7(*a*), and 7(*b*) discussed above, there are characteristics in the terminal connector for the regulator 65 which controls output of the AC generator 42 serving as a generator provided to the motorcycle 10, and to which the first external terminal 117 and the second external terminals 122 are connected with the bolts 126 and the nuts 111 (see FIG. 4(*b*)). Specifically, the terminal connector 66 includes the multiple terminal units (i.e., the cathode-side connecting unit 66A, the generator-side connecting units 66B to 66D, and the ground-side connecting unit 66E) to which the first external terminal 117 or the second external terminal 122 is individually connected. Terminal units 66A to 66E are arranged in the width direction. Terminal units 66A to 66E are each formed as a support base for screw-tightening, to which one of the external terminals (i.e., the first external terminal 117, the second external terminal 122) is connected. The identification is formed in each of the terminal units 66A to 66E. At least two of the terminal units 66A to 66E have different groove widths M1, M2.

Thus, by forming the identification in each of the terminal units 66A to 66E, the connection positions of the first external terminal 117 and the second external terminals 122 are made easily recognizable.

Moreover, by making the groove width M1 of the terminal unit 66A different from the groove widths M2 of the terminal unit 66B to 66E, the widths W1, W2 of the first external terminal 117 and the second external terminals 122 to be connected to the terminal units 66A to 66E can be made different from each other corresponding to the terminal units 66A to 66E. Incorrect assembling of the first external terminal 117 having the non-corresponding width W1 is preventable, so that the first external terminal 117 having the wide width W1 may be prevented from connecting to the terminal units 66B to 66E having the narrow groove widths M2. Furthermore, in combination with the identification, an operation of incorrectly connecting the first external terminal 117 and the second external terminals 122 to the terminal units 66A to 66E is easily avoided. For example, although the second external terminal 122 having the narrow width W2 can be connected to the terminal unit 66A having the wide groove width M1, this operation can easily be avoided, and such incorrect assembling can easily be avoided.

Additionally, by using the terminal units 66A to 66E as the support bases for screw-tightening, a more secure connection of the first external terminal 117 and the second external terminals 122 is accomplished.

As shown in FIGS. 3 to 6 discussed above, the terminal units 66A to 66E include, for example, the cathode-side connecting unit 66A to which the first external terminal 117 at the cathode-terminal side of the battery 97 is connected, the ground-side connecting unit 66E which is connected to the ground, and to which the second external terminal 122 at the anode-terminal side of the battery 97 is connected, and the generator-side connecting units 66B to 66D which are three generator-side connecting units and to which the second external terminals 122 at the side of the AC generator 42 are connected. This may make it possible to rectify, by the regulator 65, an alternating current generated by the AC generator 42 and to supply the rectified current to the battery 97, while adjusting the voltage.

The arrangement of the terminal units 66A to 66E can be arranged, so that the cathode-side connecting unit 66A and the ground-side connecting unit 66E are respectively arranged at both ends in the arrangement direction, and the generator-side connecting units 66B to 66D arranged between the cathode-side connecting unit 66A and the ground-side connecting unit 66E. This allows the cathode-side connecting unit 66A and the generator-side connecting units 66B to 66D, which are the power supply system, to be arranged apart from the ground-side connecting unit 66E, which is the ground system.

As shown in FIG. 4 discussed above, as the identification, the "+" symbol is engraved in the cathode-side connecting unit 66A, the "−" symbol is engraved in the ground-side connecting unit 66E, and the "~" symbol is engraved in each of the generator-side connecting units 66B to 66D. Accordingly, the identification is less likely to disappear, and the identification of the terminal units 66A to 66E is favorably made over an extended period of time.

The groove width M1 of the cathode-side connecting unit 66A is formed wider than the groove widths M2 of the ground-side connecting unit 66E and the generator-side connecting units 66B to 66D. In addition, the groove width M2 of the ground-side connecting unit 66E is formed identical to the groove widths M2 of the generator-side connecting units 66B to 66D. Accordingly, the width W1 of the first external terminal 117, which should be connected to the cathode-side connecting unit 66A, can be made wider than the groove widths M2 of the ground-side connecting unit 66E and the generator-side connecting units 66B to 66D. The first external terminal 117, which should be connected to the cathode-side connecting unit 66A, can be prevented from being connected to the ground-side connecting unit 66E and the generator-side connecting units 66B to 66D.

As shown in FIGS. 4 to 6 discussed above, the female screws 111*a* for screw-tightening the first external terminal 117 and the second external terminals 122 to the terminal units 66A to 66E are formed in the terminal units 66A to 66E. The center of the female screw 111*a* for the cathode-side connecting unit 66A is provided at a position offset with respect to the center of the groove width M1 in the groove-width direction. The centers of the female screws 111*a* for the ground-side connecting unit 66E and the generator-side connecting units 66B to 66D are provided at the centers of the groove widths M2. Accordingly, when the second external terminal 122, which can be connected to the ground-side connecting unit 66E and the generator-side connecting units 66B to 66D, is screw-tightened to the cathode-side connecting unit 66A, the second external terminal 122, which can be connected to the ground-side connecting unit 66E and the generator-side connecting units 66B to 66D, comes closer to one end of the groove width M1 of the cathode-side connecting unit 66A. Hence, such incorrect assembling thereof can easily be checked. Thus, the second external terminal 122 can be correctly reconnected to correct one of the terminal units 66B to 66E immediately.

In an embodiment of the invention, the bolt insertion hole 91*a* and the female screw 111*a* (see FIG. 4(*b*)) are offset with respect to the groove-width center line 106 of the terminal groove 66*a* toward the terminal groove 66*b*, as shown in FIG. 4(*a*). However, the structure may not be limited thereto. The bolt insertion hole 91*a* and the female screw 111*a* may be offset at a side opposite to the terminal groove 66*b* by the offset amount 5. Thereby, when the external cable 75 is incorrectly assembled to the terminal groove 66*a* as in FIG. 9(*a*), the end portion on the side of the terminal groove 66*b* of the terminal groove 66*a* can be separated from the second external terminal 122 by the distance δ1, and incorrect assembling is further recognized.

Although the nut 111 that is separate from the connection terminal 91 is attached to the connection terminal 91 as shown in FIG. 4(*b*), the structure is not limited thereto. The nut may be formed integrally with the connection terminal 91, or the female screw may be formed in a thick portion that is provided to the connection terminal 91.

A terminal connector for a regulator, in accordance with an embodiment of the invention, may be suitable for a motorcycle.

DESCRIPTION OF REFERENCE NUMERALS

10 MOTORCYCLE
42 GENERATOR (AC GENERATOR)
65 REGULATOR
66 TERMINAL CONNECTOR
66A to 66E TERMINAL UNIT (CATHODE-SIDE CONNECTING UNIT, GENERATOR-SIDE CONNECTING UNIT, GENERATOR-SIDE CONNECTING UNIT, GENERATOR-SIDE CONNECTING UNIT, GROUND-SIDE CONNECTING UNIT)
91 CATHODE-SIDE TERMINAL (CONNECTION TERMINAL)
92 to 94 GENERATOR-SIDE TERMINAL (CONNECTION TERMINAL)
95 GROUND-SIDE TERMINAL (CONNECTION TERMINAL)
95 BATTERY
111*a* FEMALE SCREW
117, 122 EXTERNAL TERMINAL (FIRST EXTERNAL TERMINAL, SECOND EXTERNAL TERMINAL)
M1 GROOVE WIDTH OF CATHODE-SIDE TERMINAL UNIT
M2 GROOVE WIDTHS OF GROUND-SIDE TERMINAL UNIT AND GENERATOR-SIDE TERMINAL UNIT

We claim:

1. A terminal connector for a regulator, wherein the regulator is configured to control an output of a generator provided to a motorcycle, the terminal connector being configured to connect the regulator and a plurality of external terminals using bolts and nuts, the terminal connector comprising:

a plurality of terminal units configured to be individually connected to the plurality of external terminals, respectively, wherein the plurality of terminal units are configured in a width direction of the terminal connector, wherein the plurality of terminal units are configured as support bases for screw-tightening, to which the plurality of external terminals are connected by screwing, respectively, wherein the plurality of terminal units each comprises an identification mark, and wherein at least two of the plurality of terminal units comprise different widths;

wherein the plurality of terminal units comprise:

a cathode-side connecting unit configured to be connected to the respective external terminal at a cathode-terminal side of a battery;

a ground-side connecting unit configured to be connected to a ground, and to the respective external terminal at an anode-terminal side of the battery; and three generator-side connecting units configured to be connected to the respective external terminals at a side of the generator, and wherein the cathode-side connecting unit and the ground-side connecting unit are respectively arranged at both ends of the terminal connector in an arrangement direction, and the three generator-side connecting units are arranged between the cathode-side connecting unit and the ground-side connecting unit.

2. The terminal connector according to claim 1, wherein the identification mark comprises one of a "+" symbol engraved in the cathode-side connecting unit, a "−" symbol engraved in the ground-side connecting unit, and a "~" symbol engraved in the generator-side connecting units.

3. The terminal connector according to claim 1, wherein a width of the cathode-side connecting unit is wider than widths of the ground-side connecting unit and the generator-side connecting units, and the width of the ground-side connecting unit is equal to the widths of the generator-side connecting units.

4. The terminal connector according to claim 1, wherein the plurality of terminal units further comprise a plurality of female screws for screw-tightening the plurality of external terminals to the plurality of terminal units, respectively, wherein a center of the female screw for the cathode-side connecting unit is configured at a position offset from a center of the width of the cathode-side connecting unit in a width direction, and wherein centers of the female screws for the ground-side connecting unit and the generator-side connecting units are configured at centers of the widths of the ground-side connecting unit and the generator-side connecting units.

5. A method for connecting a terminal connector of a regulator, the method comprising:

connecting a plurality of external terminals to a plurality of terminal units of the terminal connector, respectively, wherein the plurality of terminal units each comprises a positioning identification mark, wherein the plurality of terminal units are configured in a width direction of the terminal connector and configured as support bases for securing the plurality of external terminals, respectively, wherein at least two of the plurality of terminal units have different widths;

wherein the plurality of terminal units comprise a cathode-side connecting unit, a ground-side connecting unit and three generator-side connecting units, wherein the cathode-side connecting unit and the ground-side connecting unit are arranged at both ends of the terminal connector in an arrangement direction, and the three generator-side connecting units are arranged between the cathode-side connecting unit and the ground-side connecting unit, wherein the connecting comprises:

connecting the cathode-side connecting unit to the respective external terminal at a cathode-terminal side of a battery;

connecting the ground-side connecting unit to a ground, and to the respective external terminal at an anode-terminal side of the battery; and connecting the three generator-side connecting units to the respective external terminals at a side of the generator of a vehicle.

6. The method according to claim 5, wherein the connecting comprises attaching one of the plurality of external terminals to the respective the terminal unit using a bolt and a screw, wherein the attaching comprises inserting the one of the plurality of external terminals between a head portion of the bolt and a terminal connection of the regulator.

7. The method according to claim 5, wherein the connecting comprises attaching one of the plurality of external terminals to the respective terminal unit using the positioning identification mark, wherein the positioning identification mark comprises at least one of an engraved "+" symbol, an engraved "~" symbol, and an engraved "−" symbol.

8. The method of claim 5, further comprising securing one of the plurality of external terminals to the respective terminal unit using a female screw, wherein a center of the female screw for the cathode-side connecting unit is configured at a position offset from a center of a width of the cathode-side connecting unit in a width direction, and wherein centers of the female screws for the ground-side connecting unit and the generator-side connecting units are configured at centers of the widths of the ground-side connecting unit and the generator-side connecting units.

* * * * *